US007343924B2

(12) United States Patent
Tojo et al.

(10) Patent No.: US 7,343,924 B2
(45) Date of Patent: Mar. 18, 2008

(54) SYSTEM FOR SUPPLYING HALOGEN GAS OR HALOGEN CONTAINING GAS AND METHOD THEREOF

(75) Inventors: Tetsuro Tojo, Osaka (JP); Jiro Hiraiwa, Osaka (JP); Osamu Yoshimoto, Osaka (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 494 days.

(21) Appl. No.: 11/033,117

(22) Filed: Jan. 12, 2005

(65) Prior Publication Data

US 2005/0247341 A1 Nov. 10, 2005

(51) Int. Cl.
*F04F 1/00* (2006.01)

(52) U.S. Cl. ..... 137/3; 137/1; 137/255

(58) Field of Classification Search ..... 137/255, 137/256, 266
See application file for complete search history.

(56) References Cited

U.S. PATENT DOCUMENTS

| | | | | |
|---|---|---|---|---|
| 3,336,111 | A * | 8/1967 | Watson et al. | 423/300 |
| 4,622,464 | A * | 11/1986 | Sukigara et al. | 250/343 |
| 5,518,528 | A | 5/1996 | Tom et al. | |
| 5,704,965 | A | 1/1998 | Tom et al. | |
| 5,935,305 | A | 8/1999 | Tom et al. | |
| 6,083,298 | A | 7/2000 | Wang et al. | |
| 6,602,433 | B1 | 8/2003 | Bhardwaj et al. | |
| 7,013,916 | B1 | 3/2006 | Pearlstein et al. | |
| 7,163,036 | B2 * | 1/2007 | Hodgson et al. | 141/231 |
| 2003/0121796 | A1 | 7/2003 | Siegele et al. | |
| 2004/0037768 | A1 | 2/2004 | Jackson | |
| 2004/0151656 | A1 | 8/2004 | Siegele et al. | |

FOREIGN PATENT DOCUMENTS

| | | | |
|---|---|---|---|
| DE | 198 43 669 C1 | | 3/2000 |
| DE | 102 01 273 A1 | | 7/2003 |
| JP | 6-271734 | | 9/1994 |
| JP | 06257899 A | * | 9/1994 |
| JP | 11-324928 | | 11/1999 |
| JP | 3058918 | | 4/2000 |
| JP | 2000-306839 | | 11/2000 |
| JP | 2001-342963 | | 12/2001 |
| JP | 2002-147696 | | 5/2002 |
| WO | WO 01/77574 A1 | | 10/2001 |

* cited by examiner

*Primary Examiner*—Kevin Lee
(74) *Attorney, Agent, or Firm*—Oblon, Spivak, McClelland, Maier & Neustadt, P.C.

(57) ABSTRACT

Since the system for supplying gas comprises a storage container, a compressor which pressurizes fluorine gas in the storage container, and a pressurized storing container which presses fit and stores the fluorine gas, by supplying fluorine gas or the like to the destination from this system for supplying gas, it is not necessary to change gas source such as a gas cylinder or the like. In this way, fluorine gas or the like can be supplied to the destination inexpensively and safely.

14 Claims, 1 Drawing Sheet

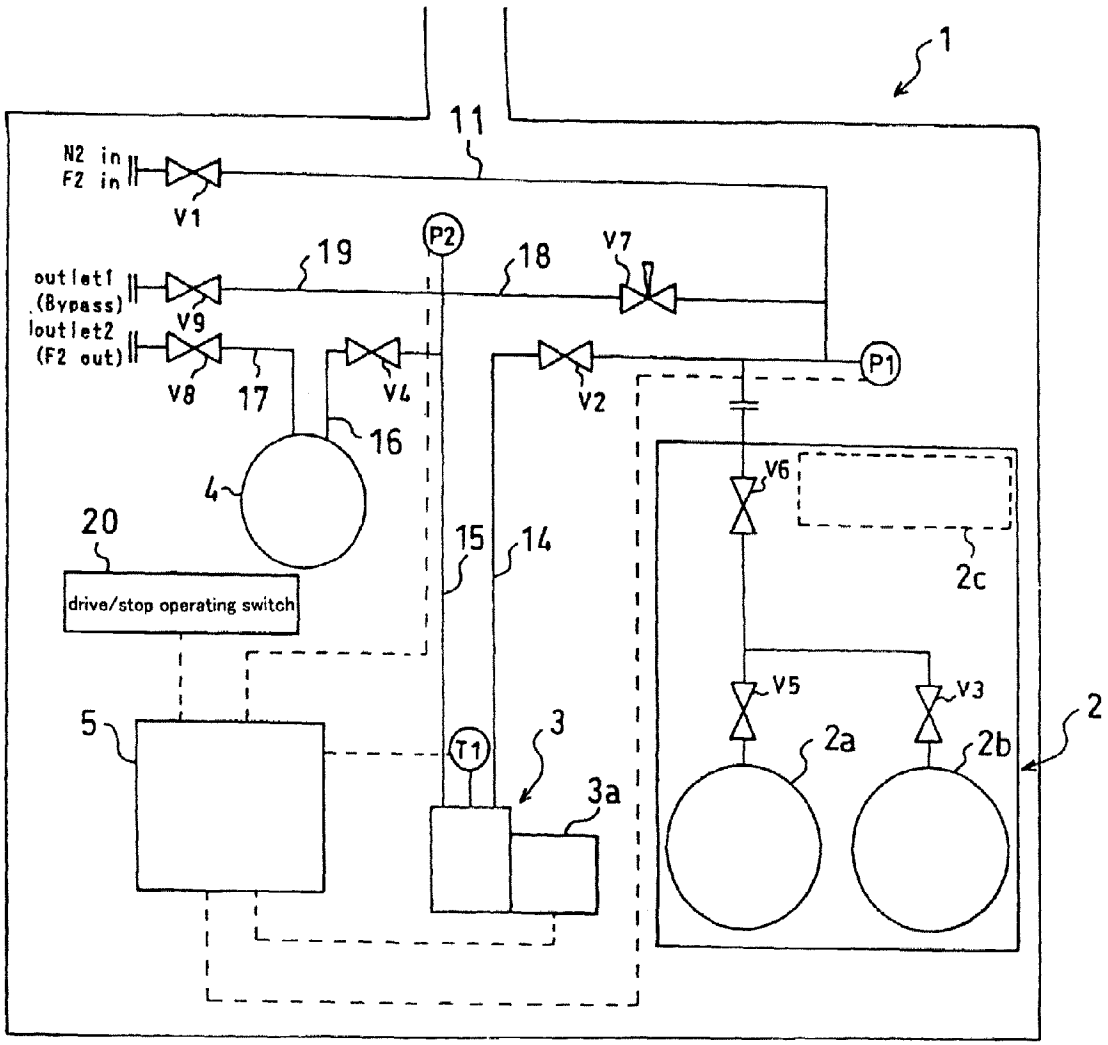
1
2
2a
2b
2c
3
3a
4
5
11
14
15
16
17
18
19
20
V1
V2
V3
V4
V5
V6
V7
V8
V9
P1
P2
T1
N2 in
F2 in
outlet1
(Bypass)
outlet2
(F2 out)
drive/stop operating switch

SYSTEM FOR SUPPLYING HALOGEN GAS OR HALOGEN CONTAINING GAS AND METHOD THEREOF

FIELD OF THE INVENTION

The present invention relates to a system for supplying halogen gas or halogen containing gas such as fluorine gas and a method thereof.

BACKGROUND OF THE INVENTION

Conventionally, in the semiconductor manufacturing field, chlorine trifluoride gas (hereinafter referred to as "$ClF_3$ gas") or nitrogen trifluoride gas (hereinafter referred to as "$NF_3$ gas") synthesized from fluorine gas has been used as cleaning gas or dry etching gas. Recently, however, destruction of the ozone layer and global warming caused by $ClF_3$ gas, $NF_3$ gas or the like are becoming serious problems. Thus, it has been decided that the use of such gases will be restricted in volume and will be totally banned in several years. As an alternative gas, fluorine gas having strong activity, toxicity and corrosion characteristic is being noted because it has no adverse effect on the ozone layer, and its global warming coefficient is zero. This fluorine gas can be used alone or together with the other gases as dilution agents. Also, neon fluoride gas (hereinafter referred to as NeF), argon fluoride gas (hereinafter referred to as ArF), krypton fluoride gas (hereinafter referred to as KrF), etc are excimer laser oscillation gases used for producing integrated circuits, and reaction gas which is a combination of rare gas and fluorine gas is often used as a source gas of them. Conventionally, in the semiconductor manufacturing site, in the case of using various gases containing fluorine gas, the required amount of pressurized gas is taken out of a pressurized gas cylinder. In addition, a fluorine gas generator, which generates fluorine gas by heating nickel fluoride and alkali metal fluoride compounds filled into the container, has been proposed. (E.g. patent reference 1 and patent reference 2 are referred.) However, since pressurized high purity fluorine gas is chemically active and dangerous, there are so many mandatory controls and difficulties in transporting it. Furthermore, halogen gas or halogen containing gas including the above-mentioned fluorine gas has strong corrosive characteristics, activity and toxicity. An apparatus or a method for supplying such gases more safely and easily than the cylinder transportation has not been proposed yet.

(Patent reference #1 Japan Laid Open tokukai 2003-81641)

(Patent reference #2 Japan Laid Open tokuhyo 2000-506220)

SUMMARY OF THE INVENTION

A gas cylinder in general is filled with gas such as fluorine gas at a relatively high pressure. (e.g. approximately 1-15 MPa) However, since fluorine gas has very strong activity, toxicity and corrosive characteristic, it is necessary to handle the cylinder carefully to avoid gas leakage at the time of carrying or replacing the cylinder. Also, the lifetime of such cylinder is short due to strong corrosive characteristic of gas therein. In addition, since a cabinet to contain multiple cylinders is expensive, there are some disadvantages in view of the operating costs. Furthermore, as it is necessary to keep extra managing place, to prepare special security equipment and to maintain gas purity or the like, there are some disadvantages in respect to equipment costs and personal expenses. As for the fluorine gas generator described in the patent reference 1, a step to refill the fluorine gas by absorbing it with nickel fluoride is necessary. This has a disadvantage regarding operating cost as it takes a lot of time and effort. Also, in this fluorine gas generator, it is difficult to control a flow rate of generated gas, therefore, the method for supplying gas downstream is restricted. An object of the present invention is to provide a system and a method for supplying halogen gas or halogen containing gas such as fluorine gas inexpensively and safely.

BRIEF DESCRIPTION OF THE DRAWINGS

FIG. 1 is a schematic view of the system for supplying fluorine gas relating to the embodiment of the present invention.

DETAILED DESCRIPTION OF THE INVENTION

A system for supplying halogen gas or halogen containing gas relating to the present invention comprises, a storage container for halogen gas or halogen containing gas, and a compressor which is located downstream of the storage container to pressurize the halogen gas or halogen containing gas. In accordance with the system of this invention, halogen gas or halogen containing gas is transferred from a gas generator or the like, and is stored in a storage container under atmospheric pressure. Hence, risk of gas leakage while in transfer can be reduced compared with a conventional cylinder. This stored gas is pressurized by a compressor located downstream as needed, and is stored in another container or is supplied to a destination directly. As a capacity of the container, 20 liters or less is preferable in view of gas leakage during the transportation of it. However, if sufficient measures against gas leakage such as ensuring of damage elimination equipment can be taken, the capacity is not required to meet the value mentioned above. Also, since the storage container can safely store gas with a pressure container, leakage of dangerous gas like fluorine gas which has strong activity, toxicity and corrosive characteristic can be prevented as much as possible. The system according to the present invention comprises, a pressurized storing container which is located downstream of the compressor and stores halogen gas or halogen containing gas pressurized by the compressor. In the present invention, gas is introduced from a gas generator or the like to a storage container, and is stored therein. Then, the stored gas in the storage container is pressurized by the compressor and is continuously pressed fit into the pressurized storing container. Also, when supplying the gas pressurized by the compressor to the destination, transferring the gas via this pressurized storing container can control gas pulsation at the time of pressurization. Furthermore, by changing the capacity of the pressurized storing container according to destinations, the pressurized gas can be stably supplied regardless of the amount of usage, especially when using a small amount of the gas. Accordingly, in addition to the above-mentioned effect, control of gas demand fluctuation by the pressurized storage container can be obtained. The system for supplying halogen gas or halogen containing gas relating to the present invention comprises, a pressurized storing container which can be dismounted as needed. Accordingly, either the storage container or the pressurized storing container can be dismounted as needed. By dismounting and replacing the storage container, material gas can be filled up. The pressurized storing container can be dismounted and replaced with the most preferable one in volume according to destinations. In accordance with the present invention, either the storage container or the pressurized storing container can be dismounted at the time of maintenance or replacement of it as needed. The system for supplying halogen gas or halogen containing gas relating to the present invention comprises, valves which are capable of shutting off gas among the storage container, the compressor and the pressurized storing container. Accordingly, in the case of storing gas into the storage container, it is possible to seal the gas in the storage container, the compressor and the pressurized storing container. Also, it is made possible to transport the storage container itself by dismounting it from the system. Furthermore, it is also possible to prevent pollution inside of these containers by sealing the gas at the time of replacement of the storage container after use or the pressurized storing container to prevent leakage of the gas filled inside of these containers. According to the present invention, fluorine containing gas can be sealed in each unit by closing shut-off valves located in the storage container, the compressor, and the pressurized storing container, and it becomes possible to convey these units, in which the gas is stored, safely to destinations. Also, even when dismounting the storage container, the compressor and the pressurized storing container individually, the work can be carried out independently. The system for supplying halogen gas or halogen containing gas relating to the invention, comprises a temperature sensor in the compressor. Accordingly, it is possible to detect a temperature abnormality in the compressor while the compressor is working. Herein, the temperature abnormality means condition which corrosiveness of halogen gas or halogen containing gas becomes violent due to the self-heating of it or the compressor, hence the danger of gas leakage increases, or which heat is generated due to the reaction of the utility with halogen gas or halogen containing gas. In accordance with the present invention, burning and over-heat problems caused by fluorine gas leakage in the compressor during the operation can be prevented by monitoring abnormalities with this temperature sensor. The system for supplying halogen gas or halogen containing gas relating to the present invention, wherein a gas sealing member which is made of fluorocarbon resin containing calcium fluoride, is located in the compressor. Since this gas sealing member made of fluorocarbon resin containing calcium fluoride is highly corrosive resistant, it is possible to prevent leakage of gas having strong corrosive characteristic such as fluorine gas. As for a content of the calcium fluoride relative to the total weight of fluorocarbon resin plus calcium fluoride, 5-50 wt % is preferable, and 20-35 wt % is more preferable. For, if the content of the calcium fluoride is less than 5 wt %, it loses the effect of the corrosive resistance, on the other hand, if the content of calcium fluoride is more than 50 wt %, the practicability decreases due to decrement of mechanical strength of fluorocarbon resin. Accordingly, balancing physical strength with corrosive resistance, the gas sealing member containing 5-50 wt % of calcium fluoride in PTFE is preferable, and 20-35 wt % is more preferable. The system for supplying halogen gas or halogen containing gas relating to the invention, wherein the compressor may be a bellows pump type or a diaphragm type. By selecting bellows type or diaphragm type compressor made of metal having corrosive resistance against halogen gas or halogen containing gas, the pressurized gas does not leak to the outside from the pressing mechanism part of the compressor, because the compressor does not have a sliding mechanism in the pressing mechanism. Also, the system for supplying halogen gas or halogen containing gas relating to the invention comprises a gas purge line, which purges halogen gas or halogen containing gas. Accordingly, after the pressure inside of the system is reduced, the gas purge line, which is connected with damage elimination equipment or a vacuum pump gas source at the destination, purges halogen gas or halogen containing gas inside of the system by repeatedly providing nitrogen gas. By this means, gas replacement or dehumidification can be achieved, and corrosion caused by pollution inside of the pipe in the system can also be prevented, so that it contributes to life extension of the system. Accordingly, in the case of supplying plural kind of halogen gas or halogen containing gas with one system, gas purity is readily improved. The system for supplying halogen gas or halogen containing gas relating to the invention, wherein the storage container is capable of storing halogen gas or halogen containing gas in the pressure range of −50 kPaG to 300 kPaG. Accordingly, gas is stored in or removed from the storage container with the compressor in the range of this pressure. If the pressure is less than −50 kPaG, the gas supplying efficiency decreases because the gas in the storage container is quickly consumed. On the other hand, if the pressure becomes higher than 300 kPa, a risk of leakage of the gas that has strong activity, corrosive characteristic and toxicity increases, so that it is not preferable. Accordingly, considering the reduction of the gas supplying efficiency and gas leakage, the gas pressure inside of the storage container is preferably −50 kPaG-150 kPaG. The system for supplying halogen gas or halogen containing gas relating to the present invention comprises plural storing containers. By this construction, increase of storage pressure can be controlled, and a proper amount of gas can be stored safely. Furthermore, by preparing the required number of storage containers, the gas amount can easily be controlled according to gas demand at destinations. The system for supplying halogen gas or halogen containing gas relating to the present invention, wherein the halogen gas is fluorine gas. Accordingly, fluorine gas having reactivity, toxicity and strong corrosiveness can be stored in the storage container, and pressurized by the compressor and supplied to the destination. Also, by locating plural storage containers, which can be replaced as needed, the gas system can be driven continuously. A method for supplying halogen gas or halogen containing gas relating to the present invention comprises, a step to store halogen gas or halogen containing gas, and a step to pressurize the gas filled in the storage container. In this construction, at first, halogen gas or halogen containing gas is loaded from the gas generator to the storage container and is stored there, and next, the gas in the storage container is pressurized by the compressor, and the pressurized gas can be pressed fit and stored into another container or supplied to the destination directly. Herein, plural storing containers, which can be replaced with new one right after all the stored gas inside of them is consumed, are prepared. Hence, it is possible to supply gas to the destination continuously and uninterruptedly. A method for supplying halogen gas or halogen containing gas relating to the present invention comprises, a step to store halogen gas or halogen containing gas in the storage container, a step to pressurize the gas filled in this storage container, and a step to pressurize the gas filled in the storage container and press fit it into the pressurized storing container. By this construction, at first, gas is loaded from the gas generator to the storage container, and stored there, after that, the gas in the storage container is pressurized by the compressor, and the pressurized gas is pressed fit and stored into the pressurized storing container. Then, the gas in the pressurized storing container can directly be supplied to the destination. Also, plural storing containers, which can be replaced with new one right after all the stored gas inside of them is consumed, are prepared. Hence, it is possible to supply gas to destinations continuously and uninterruptedly. Accordingly, in addition to the above effect, fluctuation of gas pressure, which occurs in the compressor, can be controlled. Also, fluctuation of pressure of the gas that is supplied from the system relating to the present invention to the end user's apparatus can be controlled. In other words, even if the gas demand in the destination varies, the pressurized storing container can absorb the demand fluctuation. A method for supplying halogen gas or halogen containing gas relating to the present invention comprises, a step to load material, which is to be mixed with halogen gas or halogen containing gas, into the pressurized storing container, and a step to mix the material with halogen gas or halogen containing gas in the pressurized storing container, and a step to supply halogen containing gas which has been mixed with the material. The halogen gas or halogen containing gas stored in the storage container is pressurized and pressed fit into the pressurized storing container. Then, the material to be mixed with halogen gas or halogen containing gas is loaded into the pressurized storing container, and is mixed with halogen gas or halogen containing gas to generate new halogen containing gas. After that, the newly generated halogen containing gas is supplied from the pressurized storing container to the destination. Although, as a material to be mixed with halogen gas, nitrogen gas, argon gas or the like, liquid or solid materials can be provided as examples, it is not limited to these materials. Herein, plural storing containers, which can be replaced with new one right after all the stored gas inside of them is consumed, are prepared. Hence, it is possible to supply gas to destinations continuously and uninterruptedly. A method for supplying halogen gas or halogen containing gas relating to the present invention, wherein the halogen gas is fluorine gas. The present invention comprises, a step to store the fluorine gas having strong activity and corrosive characteristic into the storage container, and a step to pressurize the fluorine gas which is filled in the storage container, and a step to pressurize the fluorine gas which is in the storage container and to press fit it into the pressurized storing container. Then, at first, fluorine gas is loaded from a gas generator or the like into a storage container and is stored there, next, the fluorine gas is pressurized by a compressor, and is pressed fit and stored into a pressurized storing container, and the pressurized fluorine gas can directly be supplied to a destination. Also, by introducing material, which is to be mixed with fluorine gas, into the pressurized storing container, the fluorine gas is mixed with the material to generate new fluoride gas, and this new fluoride gas can be supplied to the destination from the pressurized storing container. Moreover, as the storage container can be safely transported to the destination with fluorine gas stored into it, plural storing containers, which can be replaced with new one right after all the gas is consumed, are prepared. Hence, it is possible to supply gas to the destination continuously and uninterruptedly.

THE PREFERRED EMBODIMENTS OF THE INVENTION

The preferred embodiment relating to the present invention is explained as follows. The preferred embodiment is an example and the system for supplying fluorine gas relating to the present invention, which is applied to a semiconductor manufacturing apparatus, is explained referring to the drawing. As shown in the drawing, the system for supplying fluorine gas 1 relating to the present invention comprises, storage container 2 which stores fluorine gas at atmospheric pressure, compressor 3 which is located downstream of the storage container 2 and vacuums and pressurizes the gas in the gas storage container 2, pressurized storing container 4 which is located downstream of the compressor 3 and presses fit and stores the gas from the compressor, and control equipment 5 or the like which is to monitor the operating condition of the system for supplying fluorine gas and instruct start/stop operation of the compressor 3. This system for supplying fluorine gas stores fluorine gas, which is generated by the fluorine gas generator (not shown), in the storage container 2 at atmospheric pressure, and moves the gas to the destination. Then, by opening valves V3, V5 and V6 belonging to the storing container 2, the fluorine gas is supplied to the compressor 3. The fluorine gas is pressurized by the compressor 3 and is pressed fit and loaded into the pressurized storing container 4, and is supplied to a semiconductor manufacturing apparatus (not shown) from the pressurized storing container 4 via valve 8. Considering gas leakage during transportation, devices of the storage container 2 except an entrance piping are contained in a specialized box, and the storage contain 2 also contains counteractive 2c or the like to treat gas in case of gas leakage. As the counteractive, if a neutralization object is fluorine gas, hydrogen fluoride or the like, alumina, soda lime, sodium fluoride or the like can be provided as examples. As a packing amount of the counteractive, sufficient amount to treat the stored gas in the storage container 2 is preferable, and approximately twice the required amount based on the calculation or experience is more preferable. For example, although in the case of treating 40 liters of fluorine gas with soda lime and making the reaction 100%, 500 g of counteractive is experimentally required, approximately 1 kg of the counteractive is preferably contained. The storage container 2, the compressor 3 and the pressurized storing container 4 are fixed to flame 10 and can be taken out, respectively. The system for supplying fluorine gas 1 is constituted of these units such as storage containers 2, the compressor 3 and the pressurized storing container 4. The storage container 2 is made of metal like stainless steel (SUS316L), which has high corrosive resistance, and has a capacity of 20 liters. Then, this storage container 2 is connected with a fluorine gas generator (not shown) via gas inlet pipe 11, and in the range of −50 kPaG-300 kPaG fluorine gas is stored inside. As shown in FIG. 1, in the case of locating two storage containers 2*a* and 2*b* as a storage container 2, at first, valve 3 is opened, the right side storage container 2*b* is used and the valve 3 is closed, next, the valve 5 is opened to use the left side storage container 2*a* if the container 2*b* lacks the residual gas. By this construction, the stored gas in the container 2*a* and 2*b* can be taken out and used to the lower limit of the pressure without waste. Also, by controlling the pressure inside of these containers according to gas use conditions, it is not necessary to treat gas more than necessary. The above-mentioned summary is an example relating to the present invention, the number of the storage container 2 is not limited to only two as a feeding system. In the gas inlet pipe 11, valve 1 which enables to shut-off gas is located. Also, on the gas inlet pipe 11, pressure gauge P1 to monitor internal pressure of the storage container 2 is located. The location of the pressure gauge P1 may be somewhere on pipe 14 between the storage container 2 and the compressor 3. The compressor 3 made of material such as stainless steel considering corrosive resistance and fatigue strength, is bellows type pump that has a bellows, and is located behind the storage container 2. At the airtight sealing part of the compressor 3, PTFE (polytetrafluoroethylene) resin gasket containing calcium fluoride having an excellent corrosive resistance is fitted. Herein, as a calcium fluoride content in the gasket, 5-50 wt % is preferable, and 20-35 wt % is more preferable. Also, thermometer T1 is located in the compressor 3 to monitor the temperature rise due to the heat condition or gas leakage. This compressor 3 is connected to the storage container 2 via suction pipe 14. In the suction pipe 14, valve 2 is located to shut off the storage container 2 and the compressor 3. Furthermore, fluorine gas is pressurized and transported downstream by the compressor 3 via gas outlet pipe 19. The gas outlet pipe 19 has a gas outlet without via the pressurized storing container 4 and valve V9 to control this outlet. Then, by opening this valve 9 (at this time, valves 4 and 8 described later are closed), the fluorine gas which is pressed fit and transported from the compressor 3 can directly be supplied to a semiconductor manufacturing apparatus (not shown) as a destination via the valve 9. Furthermore, the compressor 3 is connected to the pressurized storing container 4 via the isolation valve 4 located on gas outlet pipe 15. By way of example, this pressurized storing container 4 is made of metal like stainless steel (SUS316L) having corrosive resistance, and its capacity is approximately 10 liters. By opening the valve 4 (at this time, the valve 9 is closed), fluorine gas (maximum pressure of 150 kPa, for example) pressurized by the compressor 3 is pressed fit and stored in the pressurized storing container 4. Pressure gauge P2, which monitors pressure of downstream of the compressor 3 or inside the pressurized storing container 4, is located on the gas outlet pipe 15. Moreover, vibration occurred in the compressor 3 can be absorbed by a bellows pipe located on pipes of V2 to V4 being located fore aft of the suction pipe 14 and the gas outlet pipe 15 connected to the compressor 3. Furthermore, loosing of pipe joints or a screw fixing part on the feeder caused by the vibration during the operation of the compressor 3 can be prevented by locating such bellows piping, or installing a vibration removing rubber at the bottom part of the compressor 3. The pressurized storing container 4 is connected to a semiconductor manufacturing apparatus (not shown) as a destination of fluorine gas via gas outlet pipe 17, and the amount of the fluorine gas supplied for the semiconductor manufacturing apparatus is controlled by the valve 8. Also, the pipe for transporting nitrogen gas used for purging this supplying system is connected with gas inlet pipe 11, and the amount of nitrogen gas, which is to be introduced to the system, can be controlled by valve 1. Furthermore, the gas inlet pipe 11 and the gas outlet pipe 17 are connected by connecting pipe 18, and by adjusting the opening degree of needle valve 7 located on the connecting pipe 18, the return amount of fluorine gas, which is pressed and transported from the compressor 3 to the storage container 2, is controlled, hence the maximum pressure of the compressor 3 can be set. Herein, in the situation where the valve 6 described above is fully opened, by restoring the fluorine gas additionally pressed fit into the storage container 2, it becomes possible to reduce the pressure inside of the compressor 3 and the pressurized storing container 4, and restore a desired safe state. Considering corrosive resistance and this system price as a product, metal bellows valves or diaphragm valves are shown for instance as valves V1-V9. All of them are made chiefly of stainless steel (SUS316L). Also, considering corrosive resistance and feeding system price as a product, for example, all pipes 11-19 are made mainly of stainless steel (SUS316L). Based on a signal from drive/stop operating switch 20, controlling apparatus 5 sends a signal to driving circuit in motor 3*a* to drive the compressor 3, and makes the compressor 3 drive or stop. Furthermore, signals from the pressure gauges P1, P2 and thermocouple T1 are also sent to the controlling apparatus 5 and the controlling apparatus 5 not only monitors whether the internal pressure is equal to a prescribed value (e.g. −50 kPa) or less, but also stops the compressor 3 when the internal pressure of the pressurized storing container 4 exceeds a prescribed value (e.g. 160 kPa). Furthermore, the compressor 3 is stopped to prevent overheat, if the temperature of the compressor 3 exceeds prescribed value (e.g. 60° C.).

Next, in the following examples 1-2, the function of the feeder for supplying fluorine gas 1 is explained.

EXAMPLE 1

Application to a Semiconductor Manufacturing Apparatus

First of all, valves V1, V3, V5 and V6 are opened, and fluorine gas generated by the fluorine gas generator (not shown) is loaded into the storage container 2 by way of gas inlet pipe 11, until the pressure inside of the storage container 2 becomes 150 kPaG. Then, after valves 1-9 are closed, all valves among the storage container 2, the compressor 3 and the pressurized storing container 4 are closed, so that the fluorine gas is sealed in the storage container 2. The fluorine gas left in the pipe is removed to the outside of the system to prevent gas leakage, and the pipe is vacuumized. In this condition, the system for supplying fluorine gas 1 is separated from the fluorine gas generator and moved close to the semiconductor manufacturing apparatus. Then, gas outlet pipe 17, and connecting pipe 19 are connected to the semiconductor manufacturing apparatus, and the gas inlet pipe 11 is connected to an apparatus for supplying nitrogen (not shown). Next, when the valves V2-V6 are opened with the valves V1, V7-V9 closed, the fluorine gas is naturally loaded into the pressurized storing container 4 from the storage container 2 as far as internal pressure of the storage container 2 is higher than that of the pressurized storing container 4. Then, by opening the valve 8, the fluorine gas, which has been stored in the pressurized storing container 4, is supplied to the semiconductor manufacturing apparatus. This makes it possible to supply cleaning gas to a cleaning room inside of the semiconductor manufacturing apparatus. After consuming a certain amount of fluorine gas, the pressure inside the storage container 2 and the pressurized storing container 4 is suppressed, and it becomes difficult to supply fluorine gas for semiconductor manufacturing apparatus stably. Also, in the case of using equipment such as a mass flow, a piezo valve or the like, if a gas supplying pressure is suppressed to 100 kPa-50 kPa, it becomes difficult to control the gas flow rate normally although it depends on a capacity of each equipment. At this stage, the compressor 3 is activated by operating the drive/stop operating switch 20. Consequently, the fluorine gas in the storage container 2 is suctioned by the compressor 3 and is pressed fit into the pressurized storing container 4. Furthermore, the fluorine gas pressed fit into the pressurized storing container 4 is supplied to the semiconductor manufacturing apparatus as a destination via the gas outlet pipe 17 with appropriate pressure. Thus, the fluorine gas in the storage container 2 is supplied from the pressurized storing container 4 in accordance with force feed ability without waste. Concretely, internal pressure in the storage container 2 can be suppressed until −80 kPa. At this time, by using pressure gauge P1, remaining amount of fluorine gas, which is to be pressurized by the storage container 2, can be monitored. Herein, if a discharged amount of fluorine gas from the compressor 3 is more than a delivered amount of that (demand of a destination such as a semiconductor manufacturing apparatus), the pressure in the pressurized storing container 4 rises soon, so that by adjusting the valve 7, a part of fluorine gas can be reduced to the storing container 2 via connecting pipe 18. However, in case the pressure in the pressurized storing container 4 exceeds a certain value due to rapid variation in amount demanded at the destination, stop signal is sent from control equipment 5 to the compressor 3 based on a upper pressure limit detecting signal to stop the compressor 3 safely.

EXAMPLE 2

Application to an Apparatus for Treating with Fluorine Gas (Surface Treatment of an Object with Fluorine Gas)

First of all, valves V1, V3, V5 and V6 are opened, and fluorine gas generated by the fluorine gas generator (not shown) is loaded into storage container 2 by way of gas inlet pipe 11 until the pressure inside of the storage container 2 becomes an atmospheric pressure. Then, valves 1-9 are closed, and the fluorine gas is sealed in the storage container 2. The fluorine gas left in the pipe is removed to the outside of the system for preventing gas leakage, and the pipe is vacuumized. In this condition, the system for supplying fluorine gas 1 is separated from the fluorine gas generator and is moved to a semiconductor manufacturing apparatus. Then gas outlet pipe 17 and connecting pipe 19 are connected to an apparatus for treating with fluorine gas, and gas inlet pipe 11 is connected to an apparatus for supplying nitrogen (not shown). In the case of surface treatment with fluorine gas, an object of the treatment may be hydrophilic or water repellency. Although it depends on treatment conditions, herein, hydrophilic treatment is described as an example. In the case of hydrophilic treatment, as an effect is exerted with a slight degree of fluoridation, conventionally after the object is set in the apparatus for treating with fluorine gas, the apparatus is vacuumized, and fluorine gas or mixed gas (fluorine gas is diluted with other gas) is loaded or pressed fit into it. In the case of loading only fluorine gas, required amount of fluorine gas is 1%-20% in ratio to volume of the apparatus for treating with fluorine gas. Since the apparatus is previously being vacuumized, by opening the valves V2, V3, V6 and V9 with the valve V1 closed, fluorine gas is supplied to the apparatus for treating from the right side storage container 2*b* until it is loaded sufficiently, and then the valves V2, V3, V6 and V9 are closed. This operation can be repeated until the gas pressure in the right side storage container 2*b* balances with internal pressure of the apparatus. In the case of sending more gas to the apparatus than the gas pressure in the right side storage container 2*b*, by driving the compressor 3 after opening valves mentioned above, gas can be supplied until the internal pressure of the storage container 2*b* becomes approximately −80 kPaG. Then, when it becomes impossible to supply gas from the storage container 2*b*, by operating the valve 5 instead of the valve V3, the above operation can be carried out, again. In the case of loading or pressing fit the above-mentioned mixed gas in the apparatus for treating, the pressurized storing container 4 is previously vacuumized, then the valves V2-V6 are opened with the valve V1 closed, and the fluorine gas is loaded in the pressurized storing container 4 from the storage container 2. A concentration of fluorine gas to treat with this mixed gas is normally 1%-20%, and the necessary amount of the fluorine gas is loaded in the pressurized storing container 4. At this time, the fluorine gas is fed and sent into the pressurized storing container 4 by the compressor 3 as needed, and the compressor 3 is stopped when the pressure feed is finished. Next, the valve V1 is opened after the valves V3 and V6 are closed, and then diluted gas is loaded in the pressurized storing container 4. If the volume of the pressurized storing container 4 is smaller than that of the apparatus for treating with fluorine, the mixed gas is controlled by pressuring and loading gas. The mixed gas, which is generated by fluorine gas mixed with diluted gas, can be supplied to the apparatus for treating fluorine by opening and closing the valve V8. At this time, by setting previously pressure of fluorine gas which is to be loaded into plural storage containers 2*a* and 2*b* according to treatment conditions, only the minimum necessary amount of gas can be prepared, moved, mixed and used. As a result, the amount of gas treatment can be minimized and removal of waste gas is not needed, which is safe and economical. In accordance with the above description relating to the system for supplying fluorine gas, the following effects can be expected.

1) The system for supplying fluorine gas 1 comprises storage container 2 which stores fluorine gas, compressor 3 which pressurizes the gas in the storage container 2, and pressurized storing container 4 to which fluorine gas is loaded from the compressor 3. These devices can be unified and located near the semiconductor manufacturing apparatus to be connected with this apparatus as a destination. Accordingly, leakage of fluorine gas having strong activity, toxicity and corrosive resistance to the outside can substantially be prevented. Also, since the fluorine gas is stored in the range of −50 kPaG-300 kPaG in the storage container 2, it is hard to leak from the storage container 2.

2) As PTFE gasket, which has excellent corrosive resistance and contains 5 wt %-50 wt % of calcium fluoride, is used in the compressor 3, leakage of fluorine gas having strong corrosive characteristic can be prevented.

3) Fluorine gas can be shut off among the storage container 2, the compressor 3 and the pressurized storing container 4 and be sealed in the feeding system. Thus, the system for supplying fluorine gas 1 can be conveyed to the destination safely and readily with the fluorine gas sealed into it.

4) If pressure requirement in the semiconductor manufacturing apparatus as a destination is few, by controlling the valve V17, a part of fluorine gas can be returned to the storage container 2 from the pressurized storing container 4 via the connection pipe 18. Furthermore, in case the pressure in the pressurized storing container 4 exceeds a certain value due to rapid variation in amount demanded at the destination, stop signal is sent from the control equipment 5 to the compressor 3 to stop it. This can prevent an abnormal rise in internal pressure of the pressurized storing container 4.

Next, modified embodiment (some modifications are added to the above-mentioned embodiment) is explained.

1] Gas which can be supplied from the above-mentioned system for supplying gas is not confined to fluorine gas. $NF_3$ gas, NeF gas, ArF gas or fluorine containing various gases can be adopted as well. Chlorine gas or the like having strong corrosive characteristic and toxicity can also be adopted. Furthermore, in the case of using different kind of gas in the same system for supplying gas, by opening the valve V5 and vacuumizing the system, or repeating replacement of the gas with inert gas such as nitrogen, another kind of gas can be loaded to the system. Also, fluorine gas can be mixed with other gas by opening the valve 1 and loading gas other than fluorine gas into the pressurized storing container 4 after the fluorine gas previously stored in the storage container 2 is pressurized by the compressor 3 and is pressed fit in the pressurized storing container 4. For example, mixed gas which is a combination of fluorine gas and nitrogen gas can be supplied to the destination via gas outlet pipe 17. Further, inert gas such as Ne, Ar or the like is supplied to the pressurized storing container 4 to be mixed with fluorine gas instead of nitrogen gas.

2] A storage amount of gas may be controlled according to gas demand at the destination, by installing plural storage containers 2 and selecting optimum one which is to be stored. Also, by sequentially replacing storage container 2 with another one, it is possible to supply gas to the destination continuously.

3] As a compressor 3, diaphragm type may be adopted as well as bellows type described in the embodiment above.

4] In the above-mentioned embodiment, although the valves V1-V9 are manually operated, a part or all of them can be changed to automatic valves and they may be opened or closed by a signal from the controlling equipment 5. Furthermore, by opening and closing the valves based on the signals from the pressure gauges P1 and P2, pressures in the storage container 2 and the pressurized storing container 4 are appropriately controlled by the controlling equipment 5.

What is claimed is:

1. A system for supplying halogen gas or halogen containing gas comprising:

a storage container which stores halogen gas or halogen containing gas;

a compressor which is located downstream of the storage container and pressurizes halogen gas or halogen containing gas;

a first pressure gauge to monitor pressure upstream of the compressor;

a second pressure gauge to monitor pressure downstream of the compressor; and a controlling apparatus to drive or stop the compressor based on a signal from the first pressure gauge and the second pressure gauge.

2. A system for supplying halogen gas or halogen containing gas according to claim 1, further comprising a pressurized storing container which is located downstream of the compressor and is capable of pressing fit the halogen gas or halogen containing gas.

3. The system for supplying halogen gas or halogen containing gas according to claim 1 or 2, wherein the storage container is removable.

4. The system for supplying halogen gas or halogen containing gas according to claim 2, further comprising a valve capable of shutting off the storage container, the compressor and/or the pressurized storing container.

5. The system for supplying halogen gas or halogen containing gas according to claim 1 or 2, further comprising a temperature sensor located in the compressor.

6. The system for supplying halogen gas or halogen containing gas according to claim 1 or 2, further comprising a compressor gas sealing member made of fluorocarbon resin containing calcium fluoride.

7. The system for supplying halogen gas or halogen containing gas according to claim 1 or 2, wherein the compressor may be bellows pump type or diaphragm type.

8. The system for supplying halogen gas or halogen containing gas according to claim 1 or 2, further comprising a gas purge line for purging halogen gas or halogen containing gas in the supplying system.

9. The system for supplying halogen gas or halogen containing gas according to claim 1 or 2, wherein the storage container is capable of storing halogen gas or halogen containing gas in the range of −50 kPaG-300 kPaG.

10. The system for supplying halogen gas or halogen containing gas according to claim 1 or 2, wherein there are a plurality of storage containers.

11. The system for supplying halogen gas or halogen containing gas according to claim 1 or 2, wherein the halogen gas is fluorine gas.

12. A method for supplying halogen gas or halogen containing gas comprising:

a step to store halogen gas or halogen containing gas in a storage container, a step to pressurize the halogen gas or halogen containing gas in the storage container, and a step to drive or stop a compressor by a controlling apparatus that operates based on a signal from a first pressure gauge to monitor pressure upstream of the compressor and a second pressure gauge to monitor pressure downstream of the compressor.

13. A method for supplying halogen gas or halogen containing gas comprising:

a step to store the halogen gas or halogen containing gas, a step to pressurize the halogen gas or halogen containing gas in a storage container, a step to pressurize the gas inside of the container and to press fit and store the gas in a pressurized storing container, a step to load material which is to be mixed with halogen gas or halogen containing gas into the pressurized storing container, a step to mix halogen gas or halogen containing gas with the material in the pressurized storing container, and a step to supply newly generated halogen containing gas.

14. The method for supplying halogen gas or halogen containing gas according to claim 13, wherein the halogen gas is fluorine gas.

* * * * *